US008165333B2

(12) United States Patent
Tracy

(10) Patent No.: US 8,165,333 B2
(45) Date of Patent: Apr. 24, 2012

(54) MODULAR SPEAKER SYSTEM

(76) Inventor: Dennis A. Tracy, Culver City, CA (US)

( * ) Notice: Subject to any disclaimer, the term of this patent is extended or adjusted under 35 U.S.C. 154(b) by 1024 days.

(21) Appl. No.: 12/109,822

(22) Filed: Apr. 25, 2008

(65) Prior Publication Data

US 2008/0267429 A1 Oct. 30, 2008

Related U.S. Application Data

(60) Provisional application No. 60/907,968, filed on Apr. 25, 2007.

(51) Int. Cl.
*H04R 9/06* (2006.01)

(52) U.S. Cl. ..... 381/335; 381/387; 181/145

(58) Field of Classification Search ..... 381/335, 381/387; 181/145
See application file for complete search history.

(56) References Cited

U.S. PATENT DOCUMENTS

| | | | | |
|---|---|---|---|---|
| 3,052,758 | A | 9/1962 | Berry | |
| 4,042,778 | A | 8/1977 | Clinton | |
| 4,139,734 | A | 2/1979 | Fincham | |
| 4,190,738 | A | 2/1980 | Samuels | |
| 4,199,657 | A | 4/1980 | Lane | |
| 4,475,226 | A | 10/1984 | Greenberg | |
| 4,757,544 | A | 7/1988 | Guy | |
| 4,882,760 | A * | 11/1989 | Yee | 381/335 |
| 4,953,223 | A * | 8/1990 | Householder | 381/387 |
| 5,000,286 | A | 3/1991 | Crawford et al. | |
| 5,146,508 | A | 9/1992 | Bader et al. | |
| 5,546,468 | A * | 8/1996 | Beard | 381/86 |
| 5,677,669 | A | 10/1997 | Walkley, IV et al. | |
| 5,743,728 | A * | 4/1998 | Cloud et al. | 432/151 |
| 5,802,194 | A * | 9/1998 | Yamagishi et al. | 381/386 |
| 6,057,659 | A * | 5/2000 | Akiyama et al. | 381/98 |
| 6,628,793 | B1 | 9/2003 | Porzilli et al. | |
| 6,751,330 | B2 | 6/2004 | Kowaki et al. | |
| 6,968,067 | B2 | 11/2005 | Lopez | |
| 7,441,630 | B1 * | 10/2008 | Herrington et al. | 181/199 |
| 2005/0058314 | A1 | 3/2005 | Lee et al. | |
| 2005/0063559 | A1 | 3/2005 | Lee et al. | |

* cited by examiner

*Primary Examiner* — Steven J Fulk
(74) *Attorney, Agent, or Firm* — Welsh Flaxman & Gitler LLC

(57) ABSTRACT

A modular speaker system includes a base assembly having a longitudinally extending, central support member and a support leg extending therefrom in a manner supporting the central support member in a generally upright configuration. The central support member includes a first end and a second end. A first woofer is secured to the base assembly, and a base assembly amplifier is mounted within the central support member and connected to the first woofer. An auxiliary speaker assembly includes a longitudinally extending, auxiliary support member having a first end a second end, the first end being shaped and dimensioned for selective engagement with the second end of the central support member. A first driver is secured to the auxiliary speaker assembly and an amplifier is mounted within the auxiliary support member and is connected to the first driver.

15 Claims, 3 Drawing Sheets

MODULAR SPEAKER SYSTEM

CROSS REFERENCE TO RELATED APPLICATION

This application claims the benefit of U.S. Provisional Application Ser. No. 60/907,968, entitled "MODULAR SPEAKER SYSTEM", filed Apr. 25, 2007.

BACKGROUND OF THE INVENTION

1. Field of the Invention

The invention relates a speaker system. More particularly, the invention relates a modular speaker system allowing usage at various locations and in various configurations.

2. Description of the Related Art

Musicians are well-acquainted with the cartage of their equipment to and from various venues. In addition to bringing their instruments, musicians often require amplifiers, speakers, woofers, and other components necessary for playing their music before a live audience. This is a difficult, but necessary, aspect of playing live music, or presenting live theatrical performances.

However, each venue presents unique challenges for sound reinforcement, for example, sound production at concerts in various venue sizes, and musicians must often adapt to their environments by utilizing different combinations of equipment to accommodate the wide variety of potential stage setups, hall, theater or auditorium sizes and, perhaps most difficult of all, the outdoor performance setting. This adds another layer to the difficulty of playing live music at different locations and simultaneously striving to maintain excellent sound quality in widely variant acoustic environments.

A need, therefore, exists for a sound reinforcement system which facilitates quick selection and optimization of the components for any given venue, while simultaneously minimizing the size and weight of the equipment which must be transported to and from the various locations. The present invention provides such a speaker system.

SUMMARY OF THE INVENTION

It is, therefore, an object of the present invention to provide a modular speaker system. The system includes a base assembly having a longitudinally extending, central support member and a support leg extending therefrom in a manner supporting the central support member in a generally upright configuration. The central support member includes a first end and a second end. A first woofer is secured to the base assembly, and a base assembly amplifier is mounted within the central support member and connected to the first woofer. An auxiliary speaker assembly includes a longitudinally extending, auxiliary support member having a first end a second end, the first end being shaped and dimensioned for selective engagement with the second end of the central support member. A first driver is secured to the auxiliary speaker assembly and an amplifier is mounted within the auxiliary support member and is connected to the first driver.

It is also an object of the present invention to provide a speaker system wherein the first end of the central support member is provided with a planar support member shaped and dimensioned to sit upon a support surface in a manner supporting the base assembly in a stable manner when used in conjunction with the support leg.

It is another object of the present invention to provide a speaker system wherein the second end of the central support member includes a coupling member shaped and dimensioned to selectively receive and support an auxiliary speaker assembly.

It is a further object of the present invention to provide a speaker system including a second woofer secured to the base assembly.

It is also an object of the present invention to provide a speaker system wherein the first woofers includes a base shaped and dimensioned to sit up a support surface in a stable manner.

It is still another object of the present invention to provide a speaker system wherein the first woofer is secured to the base assembly via a first coupling arm extending between the central support member and the first woofer.

It is yet another object of the present invention to provide a speaker system wherein the amplifier includes a source connection and a power connection, the source connection and power connection being linked to an external connection point for connection to a remote source and a remote power source.

It is also an object of the present invention to provide a speaker system wherein the external connection point is in the support leg.

It is still a further object of the present invention to provide a speaker system wherein the first end of the auxiliary support member includes a coupling member shaped and dimensioned for selective engagement with a coupling member at the second end of the central support member.

It is yet a further object of the present invention to provide a speaker system wherein the second end of the auxiliary support member includes a coupling member shaped and dimensioned to selectively receive and support an additional auxiliary speaker assembly.

It is also an object of the present invention to provide a speaker system including a second driver secured to the auxiliary speaker assembly.

It is another object of the present invention to provide a speaker system wherein the first driver is secured to the auxiliary speaker assembly via a first coupling arm extending between the auxiliary support member and the first driver.

It is a further object of the present invention to provide a speaker system wherein the auxiliary amplifier includes a source connection and a power connection, the source connection and power connection being linked to an external connection point for connection to a remote source and a remote power source.

It is also an object of the present invention to provide a speaker system wherein the external connection point is in the support leg.

It is another object of the present invention to provide a speaker system further including a second auxiliary speaker assembly secured to the auxiliary speaker assembly.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
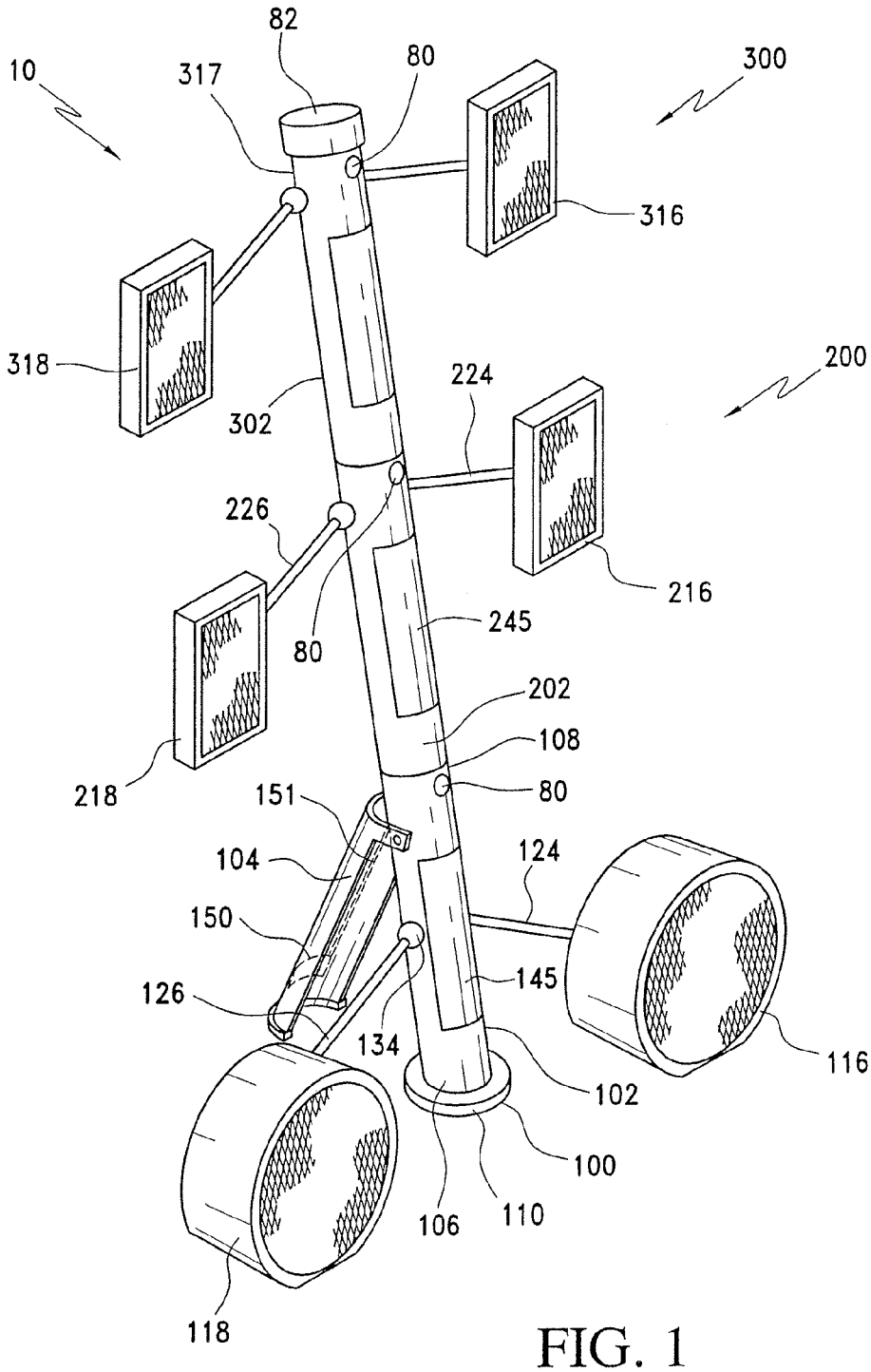
FIG. 1 is a perspective view of the present modular sound reinforcement system.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely a basis for teaching one skilled in the art how to make and/or use the invention.

With reference to the various figures, a modular speaker system 10 is disclosed. The speaker system 10 includes a base assembly 100 to which a plurality of auxiliary speaker assemblies 200, 300 may be secured in a manner creating a customized, modular speaker system 10 adapted for creating a customized modular sound reinforcement system, optimized for the power requirements and acoustic criteria of each specific performing (performance) environment. As will be explained in the following disclosure, the present speaker system 10 is adapted for a variety of uses through its modular nature, as well as its ability to permit ready assembly and disassembly.

The base assembly 100 includes a longitudinally extending, cylindrical, central support member 102 and a support leg 104 extending therefrom in a manner supporting the central support member 102 in a generally upright configuration. As will be discussed below in greater detail, the support leg 104 is cylindrical and provides a passageway for coupling the various drivers used in accordance with the present invention with a power source. The support leg 104 is pivotally secured to the central support member 102 allowing the support leg 104 to collapse onto the central support member 102 for compact storage when the present speaker assembly 10 is disassembled.

The central support member 102 includes a first end 106 a second end 108. The first end 106 is provided with a planar support plate 110 shaped and dimensioned to sit upon a support surface 112 supporting the base assembly 100 in a stable manner when used in conjunction with the support leg 104. The second end 108 of the central support member 102 includes a coupling member 114 shaped and dimensioned to selectively receive and support an auxiliary speaker assembly 200. In accordance with a preferred embodiment, the coupling member 114 is a female coupling member shaped and dimensioned to receive a similarly shaped male coupling member 214 extending from the auxiliary speaker assembly 200 in a manner discussed below in greater detail. The female and male coupling members 114, 214 may further be provided with selective locking structures for adding to the stability of the connection between the central support member 102 and the auxiliary speaker assembly 200. In accordance with a preferred embodiment of the present invention, the male and female coupling members 114, 214 are provided with bayonet type locking structures, although those skilled in the art will appreciate other coupling mechanisms may be employed without departing from the spirit of the present invention.

A first woofer 116 and a second woofer 118 are secured to the base assembly 100. Each of the first and second woofers 116, 118 including a base 120, 122 shaped and dimensioned to sit upon a support surface 112 in a stable manner taking advantage of the mass of the woofers 116, 118 to significantly lower the whole assembly's center of gravity. As such, the first and second woofers 116, 118 support themselves upon the support surface 112 while also adding to the stability of the base assembly 100 by functioning as additional legs extending from the central support member 102. This adds stability to the entire speaker assembly 10 and allows for the attachment of additional auxiliary speaker assemblies in the manner discussed below.

Figure 3:
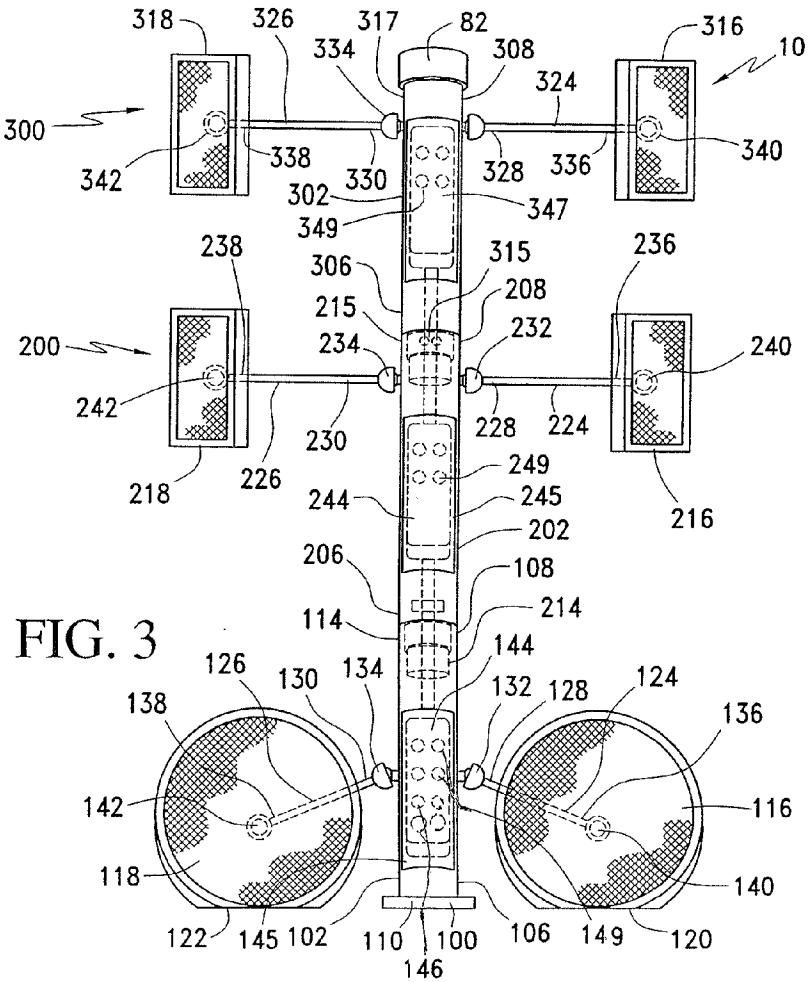
FIGS. 2 and 3 are respectively a side view and a front plan view of the system.
Figure 2:
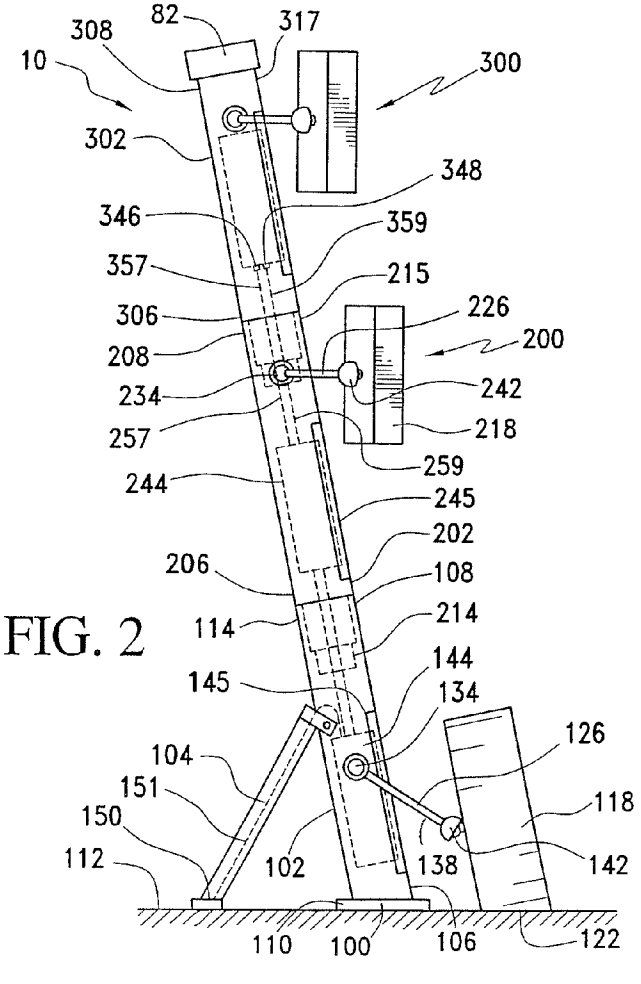
Figure 4:
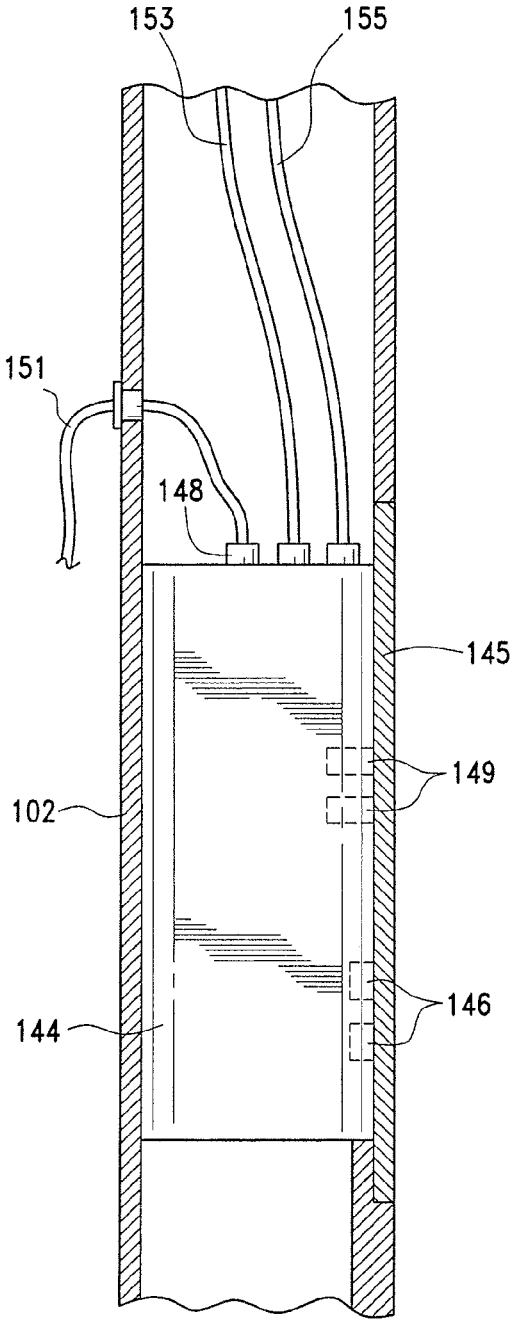
FIG. 4 is a detailed cross sectional view showing wiring in accordance with the present invention.
Figure 5:
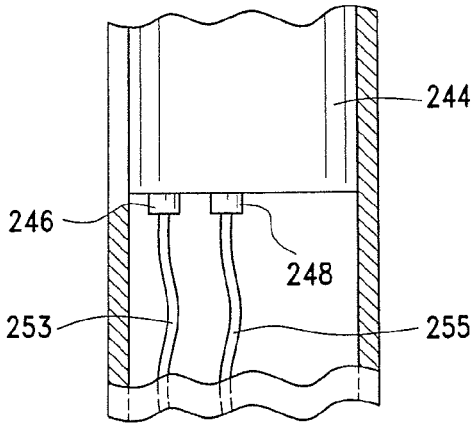
FIGS. 5 and 6 are cross sectional views showing wiring used in attachment of the base assembly and auxiliary speaker assembly.
Figure 6:
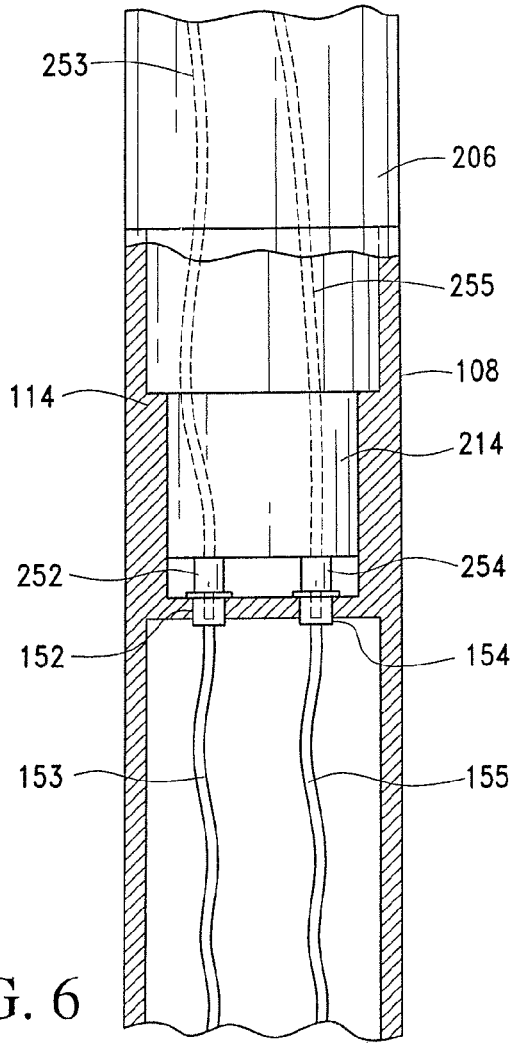

First and second coupling arms 124, 126 extend between the central support member 102 and the respective first and second woofers 116, 118. Each of the first and second coupling arms 124, 126 includes a first and a second end. The first ends 128, 130 of the first and second coupling arms 124, 126 are coupled to the central support member 102 via a swivel joint 132, 134 allowing free movement therebetween and the second ends 136, 138 of the first and second coupling arms 124, 126 are similarly coupled to the respectively first and second woofers 116, 118 via a swivel joint 140, 142 allowing free movement therebetween. The use of swivel joints 132, 134 in connecting the first and second coupling arms 124, 126 to the central support member allows the woofers 116, 118 to be folded close to the central support member 102 during storage and moved outwardly as shown in FIGS. 1, 2 and 3 when the speaker assembly 10 is placed into use. It is contemplated in accordance with a preferred embodiment of the present invention the swivel joints are of a ball and socket type construction and are maintained in desired orientations through the implementation of various locking structures (not shown) known to those skilled in the art. For example, the locking structure may take the form of locking pins, compression members, frictional resistance members, etc.

A base member amplifier 144 is mounted within the central support member 102 and drives the first and second woofers 116, 118. Those skilled in the art will appreciate the base member amplifier may also be provided with various signal processing components known to those skilled in the art. The base member amplifier 144 is mounted within the central support member 102 and is covered by a removable plate 145 for ready access by a user of the present speaker assembly 10.

The base member amplifier 144 is electrically coupled to the respective first and second woofers 116, 118 via wires (not shown) extending from the base member amplifier 144, through the central support member 102, through the respective first and second coupling arms 124, 126 and into the connections of the first woofer 116 and the second woofer 118.

The base member amplifier 144 further includes source connections 146, a power connection 148 and various control members 149. The source connections 146 allow for one to attach various sound sources directly to the base member amplifier 144. The source signals are then processed by the base member amplifier 144 using conventional sound processing techniques and distributed to the various drivers making up the present speaker assembly 10. The power connection 148 of the base member amplifier is linked to an external connection point 150 within the support leg 104 via a wire 151 for connection to a remote power source.

As discussed above, the base assembly 100 is shaped and dimensioned for supporting one or more auxiliary speaker assemblies 200, 300. The first auxiliary speaker assembly 200 includes a longitudinally extending, auxiliary support member 202 having a first end 206 and a second end 208. The first end 206 includes a coupling member 214 shaped and dimensioned for selective engagement with the coupling member 114 at the second end 108 of the central support member 102. More particularly, and as discussed above in accordance with a preferred embodiment of the present invention, the coupling member 214 at the first end 206 of the auxiliary support member 202 is a male coupling member shaped and dimensioned for receipt within the female coupling member 114 at the second end 108 of the central support member 102 of the base assembly 100.

The second end 208 of the auxiliary support member 202 includes a coupling member 215 shaped and dimensioned to selectively receive and support an additional auxiliary speaker assembly 300. As with the respective male and female coupling members 214, 114 of the auxiliary support member 202 and the central support member 102, and in accordance with a preferred embodiment of the present invention, the coupling member 215 at the second end 208 of the auxiliary support member 202 is female coupling member shaped and dimensioned to receive a similarly shaped male member 315 extending from another auxiliary speaker assembly 300. As with the connection of the base assembly and the auxiliary speaker assembly, the male and female coupling members 315, 215 may further be provided with selective locking structures for adding to the stability of the connection between the auxiliary support member 202 and the auxiliary speaker assembly 300.

The auxiliary speaker assembly 200 includes a first support arm 224 connecting a first driver 216 to the auxiliary support member 202 and a second support arm 226 connecting a second driver 218 to the auxiliary support member 202. Each of the first and second support arms 224, 226 includes a first and a second end. The first ends 228, 230 of the first and second support arms 224, 226 are coupled to the auxiliary support member 202 via a swivel joint 232, 234 allowing free movement therebetween and the second ends 236, 238 of the first and second support arms 224, 226 are similarly coupled to the respectively first and second driver assemblies (for example, and in accordance with a preferred embodiment, which is composed of a midrange driver and tweeter, or high frequency driver (not shown)) 216, 218 via a swivel joint 240, 242 allowing free movement therebetween. The use of swivel joints 232, 234 in connecting the first and second coupling arms 224, 226 to the auxiliary support member 202 allows the first and second driver assemblies 216, 218 to be folded close to the auxiliary support member 202 during storage and moved outwardly as shown in FIG. 1 when the speaker assembly 10 is placed into use. As discussed above with regard to the base assembly, the swivel joints are maintained in desired orientations through the implementation of various locking structures (not shown) known to those skilled in the art. For example, the locking structure may take the form of locking pins, compression members, frictional resistance members, etc.

An auxiliary member amplifier 244 drives the first and second drivers 216, 218. The auxiliary member amplifier 244 is mounted within the auxiliary support member 202 and is covered by a removable plate 247 for ready access to various control members/source inputs 249 along the auxiliary member amplifier 244 by a user of the present speaker assembly 10. The auxiliary member amplifier 244 is electrically coupled to the respective first and second driver assemblies 216, 218 via wires (not shown) extending from the auxiliary member amplifier 244, through the auxiliary support member 202, through the respective first and second support arms 224, 226 and into the connections of the first driver 216 and the second driver 218.

The auxiliary member amplifier 244 further includes a source connection 246 and a power connection 248. The source connection 246 and power connection 248 are linked to the base member amplifier 144 via output wires 153, 155 providing a power and source output from the base member amplifier 144. This is achieved by extending input wires 253, 255 from the source connection 246 and the power connection 248 of the auxiliary member amplifier 244 to the first end 206 of the auxiliary support member 202. The input wires 253, 255 are provided with terminal connections 252, 254 shaped and dimensioned for selective coupling with the output wires 153, 155 extending from the base member amplifier 144 to the second end 108 of the central support member 102. As with the input wires 253, 255 of the auxiliary member amplifier 244, the output wires 153, 155 of the base member amplifier 144 are provided with mating terminal connections 152, 154 shaped and dimensioned for selective coupling with the terminal connections 252, 254 of the input wires 253, 255 of the auxiliary member amplifier 244. As those skilled in the art will appreciate, the wires and connections employed in linking the base member amplifier to the auxiliary member amplifier may take various forms, including but not limited to RCA connections, XLR (extra long run) connections, optical connections, USB connections, Firewire connections, Ethernet connections, as well as integrally formed pin connection structures commonly used in the electronics industry.

As shown in accordance with the embodiment disclosed with reference to FIG. 3, the speaker assembly 10 is provided with a second auxiliary speaker assembly 300. As with the other auxiliary speaker assembly discussed above, this auxiliary speaker assembly includes a longitudinally extending, auxiliary support member 302 having a first end 306 a second end 308. The first end 306 includes a male coupling member 315 shaped and dimensioned for selective engagement with the female coupling member 215 at the second end 208 of the auxiliary support member 202. The male coupling member 315 at the first end 306 of the auxiliary support member 302 is a male coupling member shaped and dimensioned for receipt within the female coupling member 215 at the second end 208 of the auxiliary support member 202 of the auxiliary speaker assembly 200. The second end 308 of the auxiliary support member 302 includes a coupling member 317 shaped and dimensioned to selectively receive and support an additional auxiliary speaker assembly.

The auxiliary speaker assembly 300 includes a first support arm 324 connecting a first driver 316 to the auxiliary support member 202 and a second support arm 326 connecting a second driver 318 to the auxiliary support member 202. Each of the first and second support arms 324, 326 includes a first and a second end. The first ends 328, 330 of the first and second support arms 324, 326 are coupled to the auxiliary support member 202 via a swivel joint 332, 334 allowing free movement therebetween and the second ends 336, 338 of the first and second support arms 324, 326 are similarly coupled to the respectively first and second driver assemblies (for example, and in accordance with a preferred embodiment, which is composed of a midrange driver and tweeter, or high frequency driver (not shown)) 316, 318 via a swivel joint 340, 342 allowing free movement therebetween. As discussed above with regard to the base assembly, the swivel joints are maintained in desired orientations through the implementation of various locking structures (not shown) known to those skilled in the art. For example, the locking structure may take the form of locking pins, compression members, frictional resistance members, etc. As with the auxiliary speaker assembly discussed above, the use of swivel joints in connecting the first and second coupling arms to the auxiliary support member allows the first and second drivers to be folded close to the auxiliary support member during storage and moved outwardly as shown in FIG. 1 when the speaker assembly 10 is placed into use.

An auxiliary member amplifier 344 drives the first and second driver assemblies 316, 318. This auxiliary member amplifier 344 is substantially similar to the one discussed above. As such, the auxiliary member amplifier 344 is mounted within the auxiliary support member 302 and is covered by a removable plate 347 for ready access to various control members/source inputs 349 along the auxiliary member amplifier 344 by a user of the present speaker assembly 10. The auxiliary member amplifier 344 includes a source connection 346 and a power connection 248. The source connection 246 and power connection 248 are linked to the auxiliary member amplifier 244 via output wires 257, 259 of the auxiliary member amplifier 244 providing a power and source output from the auxiliary member amplifier 244. This is achieved by extending input wires 357, 359 from the source connection 346 and the power connection 348 of the auxiliary member amplifier 344 to the first end 306 of the auxiliary support member 302. The input wires are provided with terminal connections (not shown) shaped and dimensioned for selective coupling with the output wires 257, 259 extending from the auxiliary member amplifier 244 to the second end 208 of the central support member 202. As with the input wires 357, 359 of the auxiliary member amplifier 244, the output wires of the auxiliary member amplifier 244 are provided with mating terminal connections (not shown) shaped and dimensioned for selective coupling with the terminal connections 352, 354 of the input wires of the auxiliary member amplifier 344. As those skilled in the art will appreciate, the wires and connections employed in linking the base member amplifier to the auxiliary member amplifier may take various forms, including but not limited to RCA connections, XLR (extra long run) connections, optical connections, USB connections, Firewire connections, Ethernet connections, as well as integrally formed pin connection structures commonly used in the electronics industry. Those skilled in the art will appreciate, that because multiple auxiliary speaker assemblies may be used, auxiliary speaker assembly 300 (as well as any other auxiliary speaker assemblies) discussed herein would also include output wires as disclosed with reference to auxiliary speaker assembly 200.

Although first and second auxiliary speaker assemblies are disclosed in accordance with a preferred embodiment, those skilled in the art will appreciate, that a single auxiliary speaker assembly or more than two auxiliary speaker assemblies may be employed without departing from the spirit of the present invention. In addition, although driver assemblies composed of a midrange and tweeter are disclosed in accordance with a preferred embodiment, those skilled the art will appreciate the specifics drivers employed in the implementation of the present invention may be varied without departing from the spirit of the present invention.

Functionality of the present modular speaker assembly may further be enhanced by the inclusion of a synchronized light source or sources 80, for example utilizing light-emitting diodes, organic light-emitting diodes, electro-luminescent films, etc., such that the amplitude, frequency and harmonic composition of the music being reproduced is displayed on the surface of the modular speaker system and varies from dim to intense for amplitude, deep red for the lowest bass frequencies up through to blue for the highest treble frequencies. The displays may be concentrically or coaxially, that is longitudinally, oriented. The light source/sources may be recessed into a channel or series of channels for protection during transport, setup and breakdown of the sound reinforcement assembly.

In addition, cooling of the present speaker assembly 10 is enhanced by the inclusion of fan 82 integrated into a removable cap of for placement upon the top auxiliary speaker assembly (in accordance with the disclosed embodiment, auxiliary speaker assembly 300). The fan 82 is oriented to draw air from the internal cavity defined by the base assembly and the auxiliary speaker assembly(s), creating a constant, cooling airflow within the present speaker assembly 10. In accordance with a preferred embodiment of the present invention, power for the fan may be provided by either connecting the fan to the power source passing through the speaker assembly or via battery power. In addition, it is contemplated many of the components of the speaker assembly will be manufactured from aluminum which functions as a natural heat sink.

Ease of construction and assembly is achieved by making the base support member 102 and the auxiliary support members 202, 302 with the same diameter. This will allow for the use of similar materials during construction, and permit versatility in the order in which various auxiliary speaker assemblies are coupled together.

It is further contemplated the individual components, that is, the base assembly and auxiliary speaker assembly(ies), may be provided with modular features allowing for ready replacement of amplifiers and signal processing software and hardware to permit adaptation for various venues.

Although various preferred shapes are disclosed in accordance with a preferred embodiment, for example, cylindrical shaped support members, those skilled in the art will appreciate that various shapes may be employed without departing from the spirit of the present invention.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A modular speaker system, comprising:

a base assembly including a longitudinally extending, central support member and a support leg extending therefrom in a manner supporting the central support member in a generally upright configuration, the central support member includes a first end a second end;

a first woofer secured to the base assembly;

a base assembly amplifier mounted within the central support member and connected to the first woofer;

an auxiliary speaker assembly including a longitudinally extending, auxiliary support member having a first end a second end, the first end being shaped and dimensioned for selective engagement with the second end of the central support member;

a first driver secured to the auxiliary speaker assembly; and an amplifier mounted within the auxiliary support member and connected to the first driver.

2. The speaker assembly according to claim 1, wherein the first end of the central support member is provided with a planar support member shaped and dimensioned to sit upon a support surface in a manner supporting the base assembly in a stable manner when used in conjunction with the support leg.

3. The speaker assembly according to claim 1, wherein the second end of the central support member includes a coupling member shaped and dimensioned to selectively receive and support the auxiliary speaker assembly.

4. The speaker assembly according to claim 1, further including a second woofer secured to the base assembly.

5. The speaker assembly according to claim 1, wherein the first woofers includes a base shaped and dimensioned to sit up a support surface in a stable manner.

6. The speaker assembly according to claim 1, wherein the first woofer is secured to the base assembly via a first coupling arm extending between the central support member and the first woofer.

7. The speaker assembly according to claim 1, wherein the amplifier includes a source connection and a power connection, the source connection and power connection being linked to an external connection point for connection to a remote source and a remote power source.

8. The speaker assembly according to claim 7, wherein the external connection point is in the support leg.

9. The speaker assembly according to claim 1, wherein the first end of the auxiliary support member includes a coupling member shaped and dimensioned for selective engagement with a coupling member at the second end of the central support member.

10. The speaker assembly according to claim 9, wherein the second end of the auxiliary support member includes a coupling member shaped and dimensioned to selectively receive and support an additional auxiliary speaker assembly.

11. The speaker assembly according to claim 1, further including a second driver secured to the auxiliary speaker assembly.

12. The speaker assembly according to claim 1, wherein the first driver is secured to the auxiliary speaker assembly via a first coupling arm extending between the auxiliary support member and the first driver.

13. The speaker assembly according to claim 1, wherein the auxiliary amplifier includes a source connection and a power connection, the source connection and power connection being linked to an external connection point for connection to a remote source and a remote power source.

14. The speaker assembly according to claim 13, wherein the external connection point is in the support leg.

15. The speaker assembly according to claim 1, further including a second auxiliary speaker assembly secured to the auxiliary speaker assembly.

* * * * *